US007524214B2

(12) United States Patent
Johnson et al.

(10) Patent No.: US 7,524,214 B2
(45) Date of Patent: Apr. 28, 2009

(54) ELECTRICAL QUICK LOCK INTERCONNECT

(75) Inventors: Robert T. Johnson, SE Everett, WA (US); Gregory D. Gessell, SE Everett, WA (US); Marnix van der Mee, Montlouis-sur-loire (FR)

(73) Assignee: The Boeing Company, Chicago, IL (US)

( * ) Notice: Subject to any disclaimer, the term of this patent is extended or adjusted under 35 U.S.C. 154(b) by 24 days.

(21) Appl. No.: 11/614,642

(22) Filed: Dec. 21, 2006

(65) Prior Publication Data

US 2007/0149064 A1 Jun. 28, 2007

Related U.S. Application Data

(60) Provisional application No. 60/754,228, filed on Dec. 27, 2005.

(51) Int. Cl.
*H01R 13/502* (2006.01)

(52) U.S. Cl. ..... 439/701; 439/716

(58) Field of Classification Search ..... 439/701, 439/215, 716–717, 532

See application file for complete search history.

(56) References Cited

U.S. PATENT DOCUMENTS 3,456,231 A * 7/1969 Zimmerman, Jr. et al. .. 439/532
3,576,520 A * 4/1971 Stauffer ..... 439/716
4,878,859 A 11/1989 Haller et al.
5,320,564 A * 6/1994 Anderson ..... 439/716
5,629,831 A * 5/1997 Eggert et al. ..... 361/624
5,803,772 A * 9/1998 Muller et al. ..... 439/716
5,836,791 A * 11/1998 Waas et al. ..... 439/709
6,172,877 B1 * 1/2001 Feye-Hohmann et al. ... 361/759
6,392,319 B1 * 5/2002 Zebermann et al. ..... 307/147

(Continued)

FOREIGN PATENT DOCUMENTS

EP 0813269 A2 12/1997

(Continued)

OTHER PUBLICATIONS

UK Intellectual Property Office Search and Examination Report for Application GB0625774.5.

(Continued)

*Primary Examiner*—Michael C Zarroli
(74) *Attorney, Agent, or Firm*—Canady & Lortz LLP; Bradley K. Lortz

(57) ABSTRACT

Electrical connection devices and systems for the electrical interconnection of systems and components within an aerospace vehicle, such as a production airplane, are disclosed. A typical quick lock interconnect comprises a manually installed and coupled modular electrical connector. The connector receptacles may be designed to "snap" onto a structural support, such as a stamped and formed or extruded rail, providing an inherent electrical ground path. A typical quick lock production interconnect may be fabricated from thermoplastic materials and plated with a metallic finish to provide for electrical bonding and shielding. The connector device may also include a novel slide latch coupling mechanism that provides a positive visual indication of a fully coupled connector eliminating the need for specialized tools. The structural support may be part of an aircraft fuselage section where the plurality of electrical connector shells each support the one or more electrical conductors coupled between separate fuselage sections.

15 Claims, 7 Drawing Sheets

U.S. PATENT DOCUMENTS 6,902,416 B2 * 6/2005 Feldman ..... 439/219

FOREIGN PATENT DOCUMENTS

| | | | |
|---|---|---|---|
| GB | 1507875 | A | 4/1978 |
| GB | 2134336 | A | 8/1984 |
| GB | 2216177 | A | 4/1989 |
| GB | 2261773 | A | 5/1993 |
| GB | 2346018 | A | 7/2000 |

OTHER PUBLICATIONS

UK Intellectual Property Office Examination Report for Application GB0625774.5, Apr. 7, 2008.

* cited by examiner

ELECTRICAL QUICK LOCK INTERCONNECT

CROSS-REFERENCE TO RELATED APPLICATION

This application claims the benefit under 35 U.S.C. §119 (e) of the following U.S. provisional patent application, which is incorporated by reference herein:

U.S. Provisional Patent Application No. 60/754,228, filed Dec. 27, 2005, and entitled "ELECTRICAL QUICK LOCK INTERCONNECT", by Johnson et al.

BACKGROUND OF THE INVENTION

1. Field of the Invention

This invention relates to production and assembly of aerospace vehicles. Particularly, this invention relates to the electrical connection system of a production aircraft.

2. Description of the Related Art

As is well known in the art, aerospace vehicles, e.g. aircraft, spacecraft, typically employ a large number electrical connections throughout their structures to facilitate communication between the various systems and components. In the production and assembly of aircraft, particularly large passenger aircraft, conventional production interconnects have had one basic function; they exist primarily for the ease of manufacturing.

Conventional circular and rectangular production interconnects are used in production aircraft. The conventional technique employed for production interconnects is to use numerous individual circular and/or rectangular connectors coupled together at specific bracket. While the conventional approach does provide a convenient specific location for the electrical connection of various systems and components, it is lacking in many significant respects. The conventional approach requires an excessive amount of volume for a specified number of electrical connections. In addition, in both cases custom brackets are created to serve as a centralized coupling station for the electrical interconnects. Thus, conventional interconnect systems are custom applications and often require unique configuration bracket designs for each location. Installation and use of the convention systems also typically entails a tedious, time-consuming tool procedure. The unique brackets combined with the current component cost and labor associated with the installation of the electrical connector to the application specific disconnect bracket drive high recurring cost in the conventional electrical interconnect system. Furthermore, as aerospace systems have evolved, there is a burgeoning need to accommodate a greater number of electrical connections that the conventional methods cannot adequately address.

The conventional rectangular production interconnects provide a greater packing ratio of electrical connectors than conventional circular production interconnects. From these two examples it becomes evident that using the circular connector will require larger brackets than the rectangular connector. This is generally due to the fact that wasted space is created by the interstices between circular interconnects disposed adjacent to one another. For example, conventional circular connector technology requires approximately one inch minimum clearance around each connector to aid in connector coupling and decoupling which increases the necessary spatial packaging volume. There is also another cost driver with the conventional circular connector. If for some reason another connector needs to be added, the bracket will need to be redesigned creating a new custom bracket configuration to be maintained in the drawing system.

The conventional rectangular connector can use one panel cutout to install up to six vertically stacked connectors. This can simplify the manufacturing of the bracket and the bracket design. If an additional connector needs to be added in a future provision, the additional connector can be more easily accommodated. Using the conventional rectangular connector provides some advantages over the conventional circular connector, but it still does not eliminate the need for unique interconnect panels and the labor associated with the installation of the electrical connectors. The labor associated with designing, fabricating and installation of the electrical connectors on the production conventional interconnect panel has not been eliminated.

A primary function for an electrical production interconnect assembly is to terminate the greatest number of electrical circuits in the smallest amount of space while providing an electrical ground path. In a conventional development, when optimal density cannot be achieved, there can be a range of negative consequences. For example, additional space may be required for larger brackets, increasing weight. Additionally, fanning out interconnects may sometimes increase wire weight. Furthermore, costs associated with designing and fabricating a larger and in the majority of situations, unique disconnect bracket are typically increased when this situation arises.

Production disconnect systems for the next generation of aircraft build requirements must meet requirements including reduced installed cost, weight, volume and airplane build cycle time. In addition, future airplane assembly sequences will require manufacturing flow times to be significantly reduced. The reduction in final assembly flow times requires a new electrical connector to be designed that enables the numerous manufacturing production breaks on the electrical wiring to be reliably joined, eliminating labor associated with the process and ultimately eliminating the unique production disconnect brackets and the use of numerous mechanical fasteners associated with the installation of the electrical connectors. Some key elements of the electrical production disconnect include the form factor, ease of mating and providing an inherent electrical ground path.

In view of the foregoing, there is a need in the art for systems and apparatuses for providing electrical interconnects in aerospace vehicles that are space efficient and light weight. There is further a need for such systems and apparatuses that reduce the excess wire weight otherwise necessary to fan out the disconnects. There is a also a need for such systems and apparatuses to reduce assembly flow times in production vehicles allowing quick and certain assembly and inspection. There is still further a need for such systems and apparatuses that can be efficiently designed and fabricated to accommodate new sets of interconnects at a reduced cost and build cycle time. These and other needs are met by the present invention as detailed hereafter.

SUMMARY OF THE INVENTION

The present invention discloses systems and apparatuses of a novel quick lock production interconnect that may be used in production aircraft. A typical quick lock production interconnect embodiment of the present invention can reduce the installed cost, weight, volume, and build cycle time in production airplane. The packaging volume of a novel quick lock production interconnect can be approximately thirty percent smaller than the conventional techniques used in the commercial airplane wiring today. Final assembly time may also be reduced as a result of a novel slide latch coupling mechanism that provides a positive visual indication of a fully coupled connector eliminating the need for specialized tools.

Further, the connector coupling mechanism can eliminate the need for specific torque values and the need for any tools to be used in the assembly sequence and the use of mechanical fasteners for mounting the receptacle to bracket may also be eliminated. The connector receptacles may be designed to "snap" onto an aluminum extrusion providing an inherent electrical ground path. The elimination of the mechanical fasteners reduces both the cost associated with the parts and the labor associated with the preparation and installation of the fasteners.

In addition, embodiments of the quick lock production interconnect can also incorporate a polarization feature to prevent the cross-mating of adjacent connectors to one another. The polarization keys can be made independent from a shell that supports the connector and can be reconfigurable.

A quick lock production interconnect may be fabricated from thermoplastic materials and plated with a metallic finish to provide the required electrical conductivity necessary for electrical bonding and electrical shielding. Employing thermoplastic materials that have been plated with conductive finish can yield an additional weight and piece part savings of approximately twenty to twenty-five percent over conventional techniques. Further cost savings may also be achieved by eliminating conventional application-unique disconnect brackets which are replaced with an efficient stamped and formed rail or metallic, e.g. aluminum, rail extrusion.

A typical embodiment of the invention comprises a system including a structural support, a plurality of electrical connector shells each supporting one or more couplable electrical conductors and a modular bracket affixed to each of the plurality of electrical connector shells, each modular bracket manually engaged to the structural support. Each modular bracket may employ a catch and a spring latch mechanism for manually engaging the structural support. The structural support may comprise a rail such that the catch engages a first edge of the rail and the spring latch mechanism engages an opposite edge of the rail.

In further embodiments, each of the plurality of electrical connector shells may be adapted for coupling the one or more electrical conductors through a plug, where the plug engages the electrical connector shell with a manual slide-and-latch mechanism. The manual slide-and-latch mechanism may include a visual indication that the plug and the electrical connector shell are engaged. In addition, each of the plurality of electrical connector shells may include a polarization key for engaging the plug, such that only a particular plug will engage a particular connector shell.

Also, each modular bracket may be capable of individual engagement. Thus, the one or more coupled electrical conductors for a particular connector can be coupled or decoupled without interfering with any adjacent connectors. In addition, engagement of the modular bracket to the structural support can conveniently provide an electrical connection between the modular bracket and the structural support. Typically, the plurality of electrical connector shells and each modular bracket comprise a metal plated polymer to yield a combination of light weight and electrical conductivity.

In one particular embodiment, the structural support is part of an aircraft fuselage section and the plurality of electrical connector shells each support the one or more electrical conductors coupled between separate fuselage sections. Thus, assembly efficiency of the aircraft is greatly improved through application of a modular quick lock production interconnect. As will be detailed hereafter, embodiments of the invention may encompass an integral system or an individual production interconnect device adapted to function as part of the integral interconnect system.

BRIEF DESCRIPTION OF THE DRAWINGS

Referring now to the drawings in which like reference numbers represent corresponding parts throughout.

DETAILED DESCRIPTION OF THE PREFERRED EMBODIMENT

1. Overview

Figure 1A:
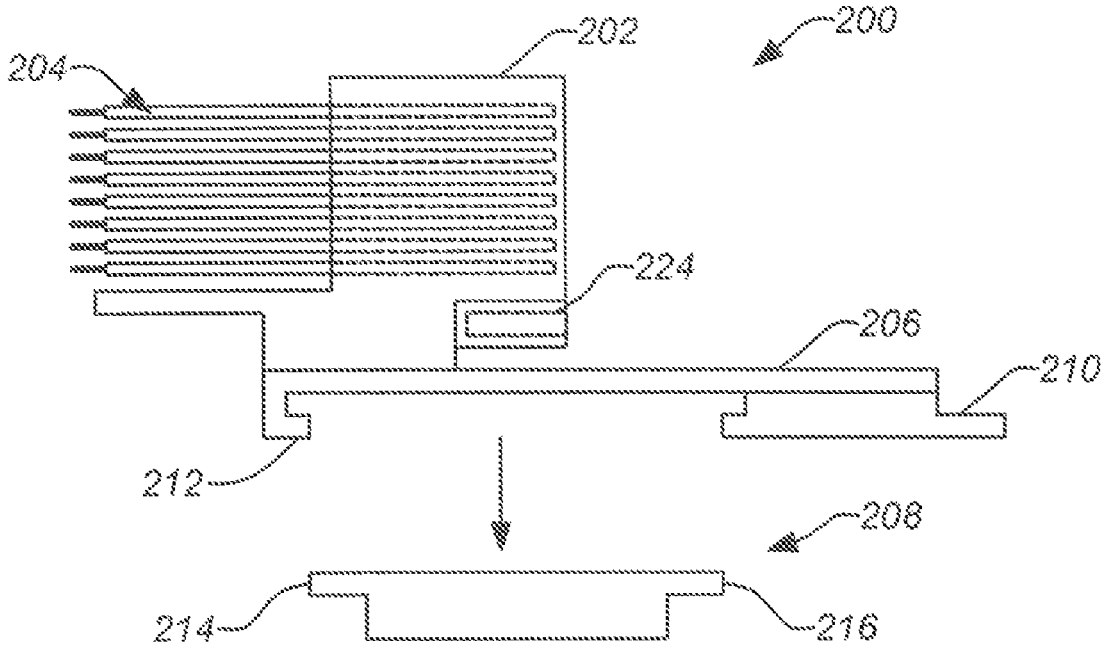
FIGS. 1A-1D illustrate significant features of an exemplary interconnect of the present invention.

Electrical connection devices and systems for the electrical interconnection of systems and components within an aerospace vehicle, such as a production airplane, are disclosed. A typical quick lock production interconnect embodiment of the present invention comprises a manually installed and coupled modular electrical connector. The connector receptacles may be designed to "snap" onto a structural support, such as a stamped and formed or extruded rail, providing an inherent electrical ground path. A typical quick lock production interconnect may be fabricated from thermoplastic materials and plated with a metallic finish to provide for electrical bonding and shielding. The connector device may also include a novel slide latch coupling mechanism that provides a positive visual indication of a fully coupled connector eliminating the need for specialized tools. The structural support may be part of an aircraft fuselage section where the plurality of electrical connector shells each support the one or more electrical conductors coupled between separate fuselage sections.

As previously mentioned, embodiments of the present invention eliminate the necessity of designing unique interconnect brackets for a production aerospace vehicle. Embodiments of the invention can also provide an inherent electrical ground path. Furthermore, some embodiments of the invention employ plated thermoplastic materials that are lighter and less expensive to manufacture than conventional metal parts. The novel interconnect design is lighter weight, eliminates numerous mechanical fasteners, and the design provides an inherent electrical ground path. This eliminates numerous installation and assembly hours from the factory. In addition, the novel interconnect does not require any unique tools or procedures for the assembly or installation.

Embodiments of the present invention also eliminate the need for a variety of mechanical interconnect brackets as with conventional systems. The novel interconnect design can employ a simple aluminum extrusion which provides the structural and electrical interface to an airframe. This enables a significant reduction in the labor associated with the installation of the receptacle-to-bracket and bracket-to-airframe interface. Thus, employing such a quick lock production interconnect design in accordance with the present invention supports reduced final assembly time.

2. Quick Lock Production Interconnect

A novel quick lock production interconnect embodiment of the present invention can eliminate the traditional metal interconnect bracket and machined aluminum circular or rectangular connectors and numerous fasteners employed in a conventional interconnect. The quick lock production interconnect can be clamped to either an extruded or stamped and formed metallic, e.g. aluminum, rail. A receptacle shell mounts to the rail by capturing a first edge of the rail as a fixed hinge point and then manually actuating a spring latch mechanism on an opposing edge of the rail that firmly attaches the receptacle shell to the rail. The receptacle fixed hinge point and the spring latch mechanism provide both a mechanical and electrical interface to the mounting rail. This interface is accomplished without the use of ancillary hardware of with any pre-installation preparations to obtain the low resistance ground path.

FIGS. 1A-1D is a schematic illustration of significant features of an exemplary interconnect 200 embodiment of the present invention. The interconnect 200 includes an electrical connector shell 202 for supporting one or more couplable electrical conductors 204, e.g. as either a plug or receptacle. For example, the electrical conductors 204 may be supported in an insulative rubber molded piece having a plurality of through holes, one for each electrical conductor. The ends of the electrical conductors 204 supported in the connector shell 202 may be made couplable to other electrical conductors by incorporating a connector end designed to engage a matching connector end. For example, the electrical connectors can include bullet end connectors couplable to matching barrel end connectors. Any type of known connector ends (e.g. spade, spring finger, etc.) may be used so long as they are capable of being supported in the connector shell 202 and engage and disengage as the matching plug is manually engaged and disengaged from the connector shell 202, as described hereafter.

The interconnect 200 also includes a modular bracket 206 affixed to the electrical connector shell 202. The modular bracket 206 and the electrical connector shell 202 can be produced as separate pieces and then attached or manufactured as a single integral element. The bracket 206 is modular because certain features of its design are standardized to allow duplication and reuse in a range of applications, e.g. engagement features to a structural support. In particular, the standardized design features allow a plurality of adjacent interconnects to be employed together in an overall assembly. At the same time, other aspects of the interconnect are customizable to accommodate variation in their application, e.g. the number and type of electrical conductors carried.

FIG. 1A illustrates the interconnect 200 as it is about to engage a structural support 208 as indicated by the arrow. The modular bracket 206 is adapted to manually clamp to the structural support 208. This significant feature enables the manual assembly (i.e. not requiring a use of hand tools) of components to reduce the assembly time of the overall build, although a simple hand tool may be used to facilitate disengagement. For example, a standard flat blade screw driver may be the only tool required to uncouple the mechanical latch mechanism enabling the receptacle to be disengaged from the structural support 208. In one embodiment, the modular bracket 206 may incorporate a catch and a spring latch mechanism 210 for manually clamping onto the structural support 208. In other embodiments, other clamping mechanisms may be employed, such as screws, hinges, fasteners, etc. For example, one embodiment may employ a cam lock feature or an over-center latch as is known in the art. The mechanism may be activated using a flat bladed screw driver or similar tool and by rotating an internal cam approximately ninety degrees. In this case, the receptacle shell is retained to the structural support. Although this embodiment still requires a simple hand tool, it still provides an simplified, efficient assembly over the conventional systems.

Figure 1B:
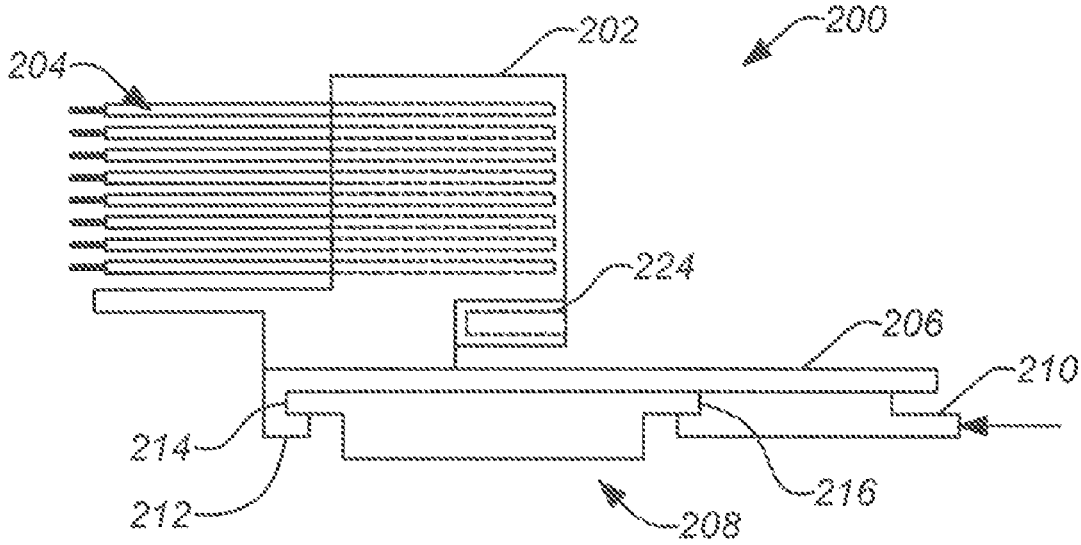
Figure 1C:
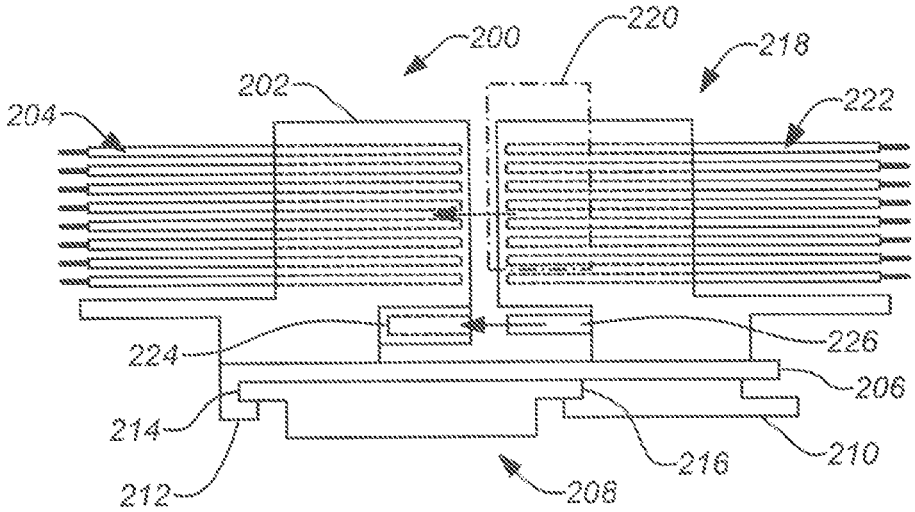
Figure 1D:
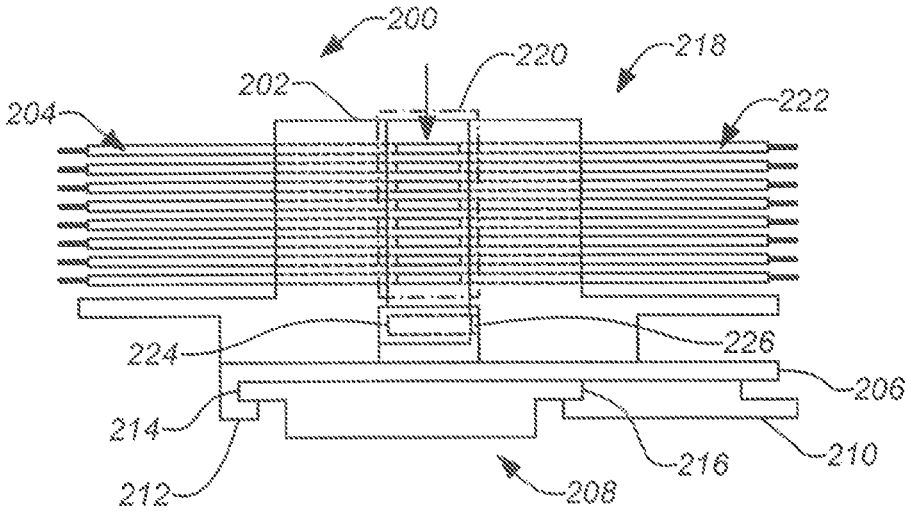

FIG. 1B illustrates the interconnect 200 engaged with the structural support 208. In this case, the structural support 208 comprises a rail (which is depicted from one end, i.e. the length of the rail goes into the page). The modular bracket 206 includes a catch 212 for engaging a first edge 214 of the rail. The spring latch mechanism 210 engages an opposite edge 216 of the rail as shown by the arrow in FIG. 1B. The spring latch mechanism 210 can incorporate another spring catch which snaps into place when the latch is pushed towards the rail. The engagement of the modular bracket 206 to the structural support 208 can also provide an electrical connection between the modular bracket 206 and the structural support 208. For example, the spring catch of the spring latch mechanism 210 can make the electrical connection with the rail to provide an electrical ground (e.g. a shielding ground) for the electrical conductors 204. It should be noted that although the structural support 208 is depicted as a rail with the modular bracket 206 engaging the outer edges 214, 216, other configurations are possible within the scope of the invention. For example, a channel rather than a rail might also be employed as the structural support 208 and/or the modular bracket can be designed to engage interior edges or other features of the structural support 208.

The electrical connector shell 202 is adapted for coupling the one or more electrical conductors 204 through a plug 218. The plug 218 supports a second plurality of electrical conductors 222 that include the matching end connectors couplable to the end connectors of the first plurality of electrical connectors 204 supported by the electrical connector shell 202. The plug 218 can engages the electrical connector shell employing a manual slide-and-latch mechanism 220 that engages features on the electrical connector shell 202 and assists in drawing the plug 218 and electrical connector shell 202 together to couple the electrical conductors 204, 222. Similar to the spring latch mechanism 210, the slide-and-latch mechanism 220 may be manually engaged without tools. In addition, the manual slide-and-latch mechanism 220 may include a visual indicator that the plug 218 and the electrical connector shell 202 are fully engaged (indicating that the conductors 204, 222 are coupled). For example, the slide-and-latch mechanism 220 indicates that the plug 218 and the electrical connector shell 202 are fully engaged after the slide-and-latch mechanism 220 is seated flush with the tops of both the electrical connector shell 202 and plug 218. Note that although the mating connector is defined here as a "plug", embodiments of the invention do not require male electrical connectors; male or female electrical connectors may be interchanged or intermingled between the electrical connector shell 202 on one side and the plug 218 on the other side, so long as the connectors are appropriate to be coupled when the components are engaged.

In addition, embodiments of the invention can incorporate features to prevent accidental misconnection among the pluralities of electrical connector shells 202 and plugs 218 which may be used close together. Each of the plurality of electrical connector shells 202 may include a polarization key 224 for engaging the plug 218. The polarization key 224 can comprise one or more keyways which mate to a particular key 226 in a specified orientation, e.g. a variable of four orientations ninety degrees apart. If more than one keyway is used for each connector, a large number of combinations are readily available to distinguish connectors employing even the same keyway and key. For example, employing two separate but identical keyways for the same connector, each having four possible orientations, enables sixteen distinct combinations. Of course many more combinations are possible with the addition of different keyways. The use of the polarization key 224 allows for a modular bracket 206 to engage the structural support 208 adjacent to a plurality of other modular brackets without confusion among the connectors. Also note that although the key and keyway that accepts it may be attributed in the present description to either the connector shell or plug they may be interchangeably applied to either element; the term polarization key only indicates a feature of some type on a component that may be altered in orientation to properly engage a matching feature on a mating component.

Figure 2A:
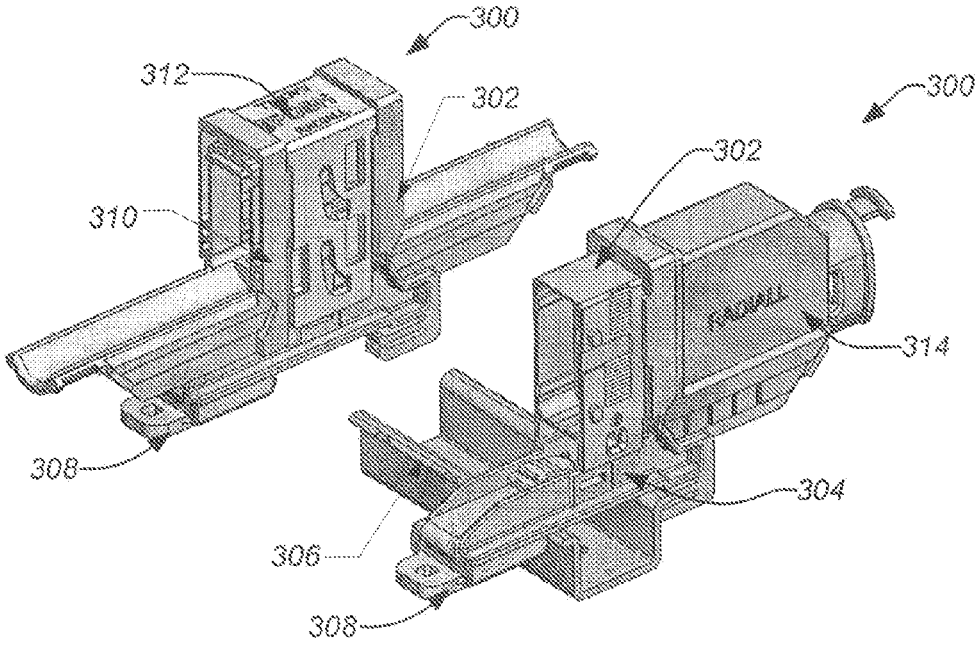
FIGS. 2A and 2B illustrate an exemplary interconnect embodiment of the present invention.
Figure 2B:
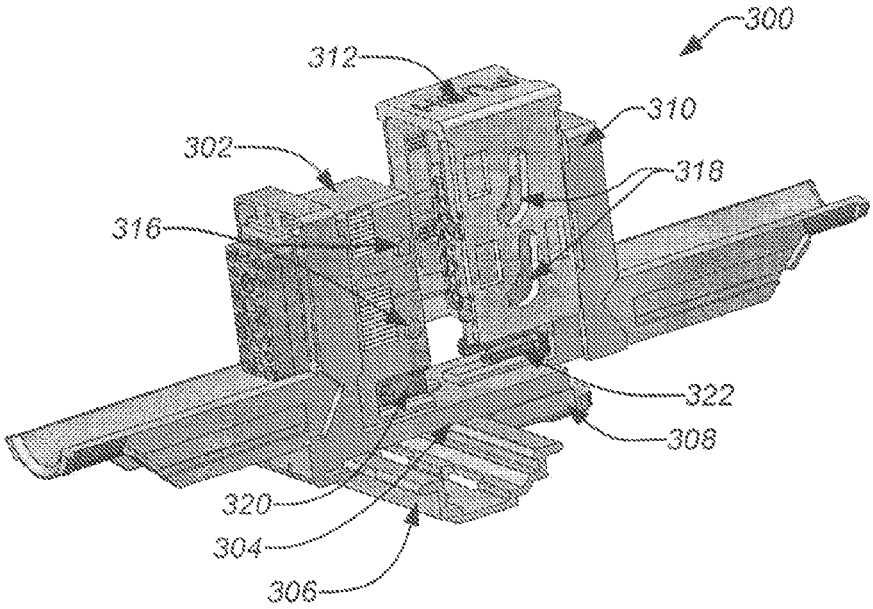

FIGS. 2A and 2B illustrate an exemplary interconnect 300 embodiment of the present invention. FIG. 2A shows the interconnect 300 with and without an engaged plug shell 310. The plug 218 previously described in FIGS. 1A-1D may comprise a plug shell 310 (similar to the connector shells 202 or 302) that incorporates the structural features of the plug for engaging the connector shell 202 or 302. The connector shell 302 is shown with an integral modular bracket 304 attached to the rail 306. Attachment to the rail 306 is secured through the spring latch mechanism 308. In the left image showing engagement of the plug shell 310 to the connector shell 302 the manual slide-and-latch mechanism 312 is shown securing the two parts together. Also shown is a backshell 314 that may be used to provide EMI shielding and limit strain of the electrical conductors in use. (A similar backshell enclosure is used on the plug in operation.) Note that the electrical conductors normally carried by the interconnect 300 are not shown to present a clear view of the other elements.

FIG. 2B illustrates the detailed example embodiment of the invention showing the connector shell 302 and the plug shell 310 as they are being engaged. (Note that the orientation of the interconnect 300 is reversed from the images of FIG. 2A.) Engagement features of the manual slide-and-latch mechanism 312 are shown as pins 316 on the connector shell 302 (receptacle) which engage the tracks 318 of the mechanism 312 carried by the plug shell 310. The pins 316 running in the tracks 318 draw the connector shells 302, 310 together and couple the electrical conductors (not shown) as a downward pressure is applied to the mechanism 312. Note that similar pairs of pins 316 and tracks 318 are employed on the opposite side of the interconnect 300 not shown. Also shown is the polarization key used to prevent mis-mating of nearby connectors. The polarization key comprises one or more keyways 320 on the connector shell 302 which engage the match keys 322 carried by the plug shell 310 as the connectors are mated. In this example, two separate keyways/keys are used which may be independently oriented, having distinct axial rotational orientations.

In the example embodiment, the connector shell is a molded part available in electrical plug and receptacle versions. The connector shell incorporates an integral strain relief with provisions to accept an EMI enclosure for zero length cable shield terminations as will be understood by those skilled in the art. The shells are constructed to mechanically retain the electrical conductor support inserts and permit their removal. The plug shell incorporates a slide latch coupling mechanism as previously described. The receptacle incorporates features that produce a mechanically rigid assembly when engaged with the plug slide latch mechanism.

The receptacle shell design also incorporates features that provide a mechanical and electrical interface to the mounting rail as previously described. The electrical ground path established by the mounting feature incorporated in the receptacle shell maintains a stable, low resistance electrical ground path for the life of the installation. This electrical ground path that is provided by the mechanical mounting feature requires no special preparation or tools during the initial assembly processes or maintenance once in service. For example, the connector shells are typically electrically grounded to the aircraft structure. The reason for this is that the wiring, which is usually shielded from both EMI and lightning threats, has this shield terminated at or on the connector shell. The connector shell may be grounded to the aircraft structure by mounting the connector shell to a metallic panel by use of mechanical fasteners. In this case, the ground path may be accomplished through the structural mounting rail which will then use ground straps to couple into the current return network. Some type of grounding feature is critical in the functionality of such electrical systems. The grounds provide an important function of draining the electrical currents off the shields that are protecting the core wires. Although, a standard flat blade screw driver may be used to uncouple the mechanical latch mechanism enabling the receptacle to be disengaged from the mounting rail.

EMI ground springs can be made integral to the shell designs. The EMI spring can form an integral part of the plug shell and make contact with the receptacle shell prior to electrical contact engagement. To provide a good ground path between plug and receptacle, the EMI spring or ground fingers (formed as an integral part of the plug shell) applies sufficient pressure onto the receptacle shell. This pressure is generated by the elasticity of these ground fingers. A continuous circumferential spring design is not required (i.e. corners may be open) provided that the EMI requirements are met.

Figure 3A:
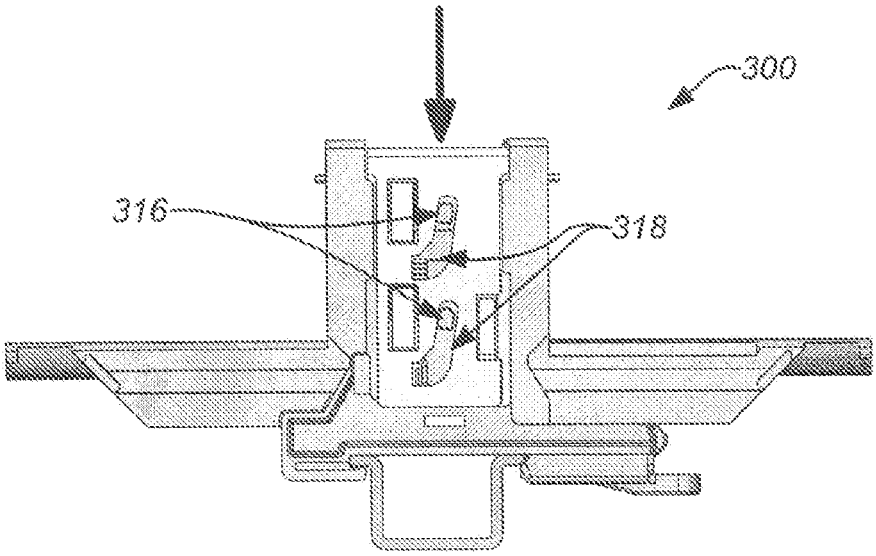
FIG. 3A further illustrates the engaged pins and tracks of the manual slide-and-latch mechanism.
Figure 3B:
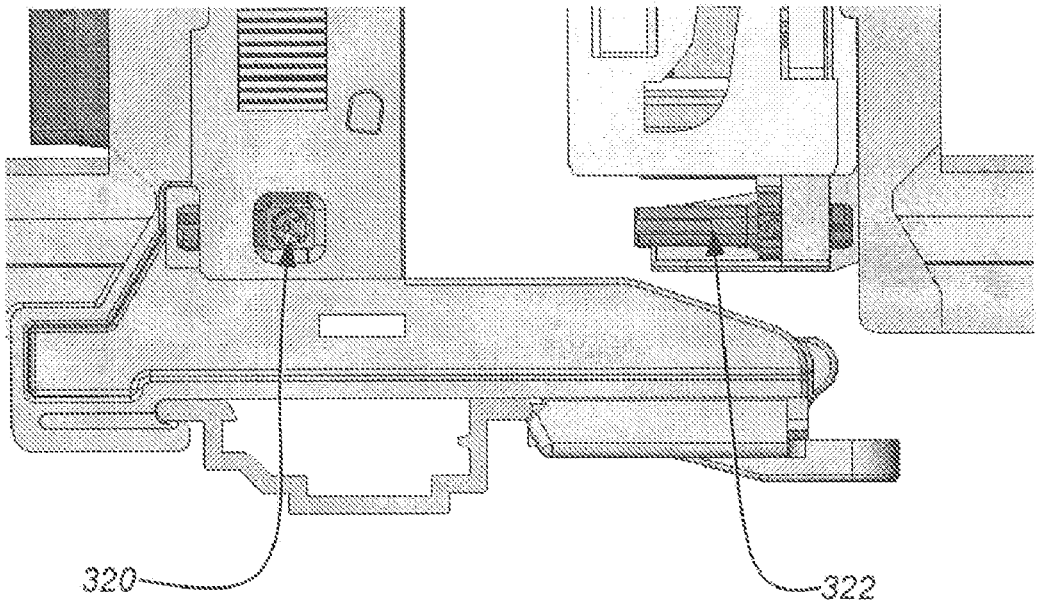
FIG. 3B further illustrates the polarization key.
Figure 3C:
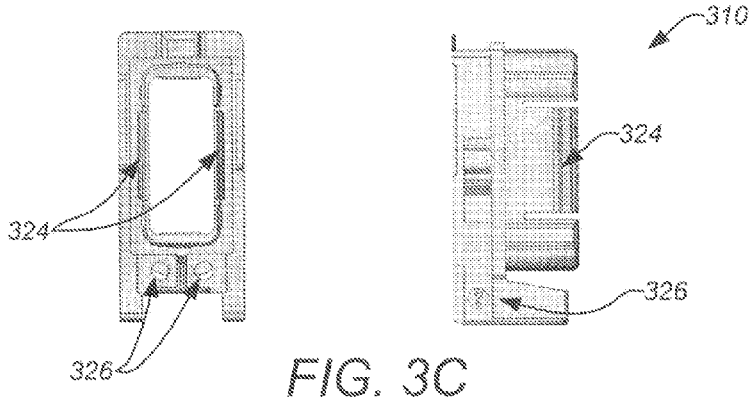
FIG. 3C further illustrates detail of the plug shell.

The connector shell incorporates ground block provisions for terminating shield cable ground wires to the connector shell. The grounding clip and retention system is designed to accept known rear release, crimp, pin contacts. The crimp barrel location is defined to ensure that a strain relief is provided to prevent the wire termination from bending at the crimp joint. FIGS. 3A-3C illustrate further manual engagement features of the exemplary interconnect embodiment of the present invention.

FIG. 3A further illustrates the engaged pins 316 and tracks 318 of the manual slide-and-latch mechanism 312. As previously mentioned, the pins 316 running in the tracks 318 draw the connector shells 302, 310 together and couple the electrical conductors as a downward pressure (shown by the arrow) is applied to the mechanism 312. The plug shell is mated to the receptacle shell by sliding the plug into the receptacle where the two shell halves engage. The slide latch mechanism can then be depressed forcing the two connector shells together creating a mechanically rigid assembly. The slide-and-latch mechanism requires a minimal amount of access to fully couple the two connector halves together. The slide latch is activated by simply pressing down on the top of the slide with either a finger or thumb until flush with the top of the plug and receptacle housing. In addition, this feature of the slide latch design provides a clear visual indication that the two connector halves are fully coupled. When the slide latch is flush with the top of the receptacle and plug shells, the slide latch is fully down and locked in position indicating that the electrical conductors are coupled.

The receptacle shell shall be fully bottomed in the plug shell providing not only a mechanically rigid assembly but a 360 degree enclosure important to the EMI shielding performance. The coupling mechanism and connector shell design incorporate a means for providing a visual reference that the slide latch mechanism is in a fully down and locked position. No tools are required to activate the slide latch mechanism to the fully down and lock position, although a standard flat blade screw driver may be used to uncouple the slide latch enabling the plug to be disengaged from the receptacle.

FIG. 3B further illustrates the polarization key. The keyways 320 on the connector shell 302 and the keys 322 on the plug shell 310 are shown. Note that a visual indicator (e.g. the letter "A") is also used to identify the proper polarization key on both sides, eliminating the need for trial-and-error fitting. Polarization of the connector shells provides a means for preventing mis-mating connectors disposed in close proximity to one another. The polarization feature is an important attribute of the quick lock production interconnect. The polarization of the connector is accomplished by means of discrete keys that can be installed and visually positioned without the use of any tools. It is impossible to mate a plug to a receptacle shell when these polarization keys are polarized differently. Polarization engagement occurs just after initial shell engagement but before the pin makes contact with the socket contact. The polarization of the plug connector shell can be accomplished by using a known polarizing post. Similarly, the polarization of the receptacle shell can be accomplished by using a known matching polarizing receptacle.

FIG. 3C further illustrates detail of the plug shell 310. The plug shell 310 incorporates latch springs 324 which serve to mechanically secure the plug shell 310 to the connector shell 302 when they are engaged. In addition, the pressure contact of the latch springs 324 with the connector shell 302 also provides electrical connectivity to enable EMI shielding. Also shown in FIG. 3C are the mounting locations 326 for the pair of polarization keys 322 previously described.

Figure 4:
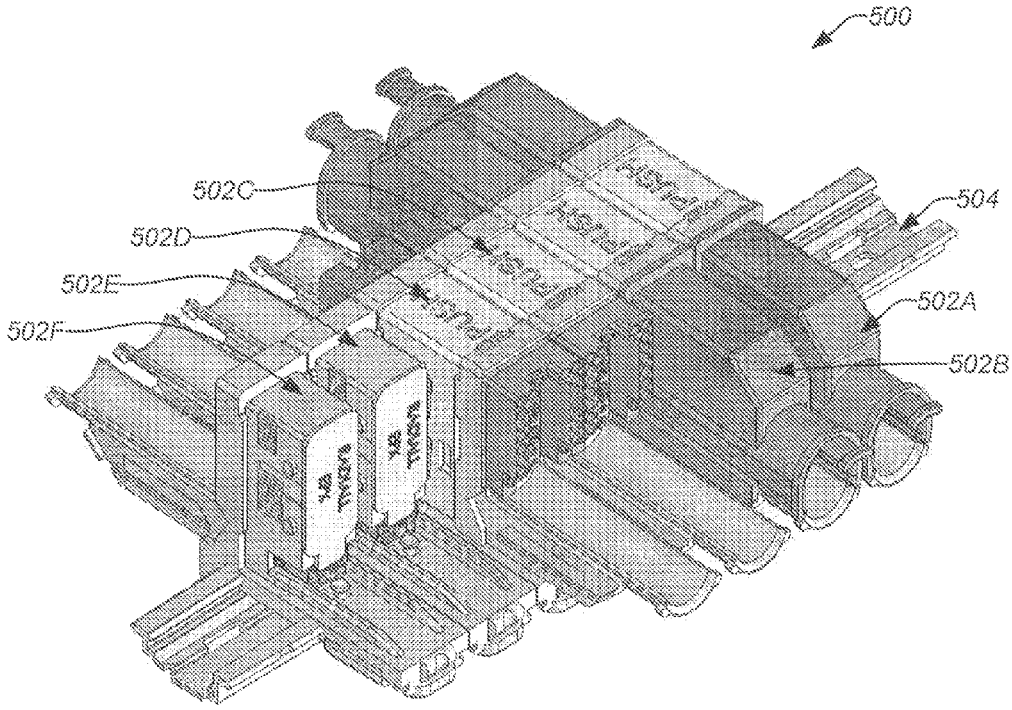
FIG. 4 illustrates a plurality of adjacent connector shells of an exemplary interconnect system embodiment of the present invention.

FIG. 4 illustrates a plurality of adjacent connector shells 502A-502F of an exemplary interconnect system 500 embodiment of the present invention. As previously discussed, this exemplary embodiment of the quick lock production interconnect is very modular. The exemplary interconnect system 500 can support a plurality of adjacent connector shells 502A-502F. Each electrical insert is removable from it's connector shell 502A-502F and each connector shell 502A-502F can be installed or removed from the mounting rail 504 independently without disturbing adjacent connector shells 502A-502F.

Embodiments of the present invention can employ a stable electrical resistance ground path from shell to shell and receptacle shell to the metal extrusion interface yielding a low resistance ground path from the receptacle shell to the supporting metal rail. A low resistance electrical path from shell to shell can be produced through selection of the appropriate metallic plating thickness. Thus, the interface provides both a mechanical and electrical interface. For example, a modified spring finger design can be employed provide the electrical path to rail interface.

Furthermore, in order to optimize the weight and cost, the shells of the quick lock production interconnect can be constructed of a metal plated polymer. The use of metal plated polymers is quickly gaining acceptance in the military and aerospace markets. Plated thermoplastic parts are currently being used for circular connectors. Thus, migration of this technology to embodiments of the present invention can be readily implemented. The plating thicknesses of the metal finishes are selected depending upon the intended application. As is known in the art, the shell to shell conductivity, shielding performance and the ability to survive an indirect lightning strike are some defining requirements in selecting and developing the appropriate plating.

For example, the connector shell may be made from high grade thermoplastic or thermoset materials known in the art. The material used for the connector housing may be a durable, resilient plastic material with sufficient stiffness to minimize deflection and distortion when mated and will not deteriorate under normal conditions of operation and aging. One attribute that should be considered when selecting the material for the connector shell, is the ability to accept a conductive metallic finish. For example, the connector shell may be plated with an electrically conductive finish of electrolytic nickel (e.g. per SAE-AMS QQ-N-290) over an electroless nickel (e.g. per SAE-AMS 2404 Class 3024). The spring catch of the spring latch mechanism 210 may be Beryllium Copper and include a gold plated grounding clip. Accessory members of the grounding clip assembly need not be gold plated, but should comply with the requirements for avoidance of dissimilar metals in intimate contact.

3. Aircraft Assembly Using Quick Lock Production Interconnect

The proposed manufacturing technique for a new aircraft program incorporates pre-integration of the structural elements, fully integrated with all the transport utilities, before shipping to a final assembly facility. This may require additional production interconnects or modifications to various wiring trays to optimize the weight, cost and ease of maintenance of the electrical wiring interconnect system. The electrical wiring system may be designed with common major airframe interfaces consistent with a final assembly plan for major component integration. The major production interconnects should be designed to achieve the highest possible level of commonality of electrical parts and processes. In addition, the design of the electrical wiring interconnect system should enable the inclusion of customer options and technology upgrades based on common parts, processes and provisioning of the product envelope.

Figure 5:
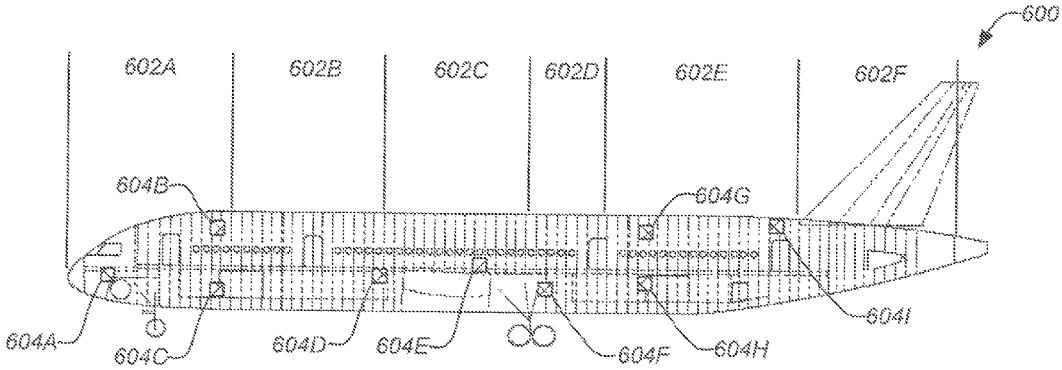
FIG. 5 illustrates employing an exemplary interconnect system embodiment of the present invention to couple distinct fuselage sections of a production aircraft.

FIG. 5 illustrates employing an exemplary interconnect system embodiment of the present invention to couple distinct fuselage sections 602A-602F of a production aircraft 600. The electrical wiring system installation can employ "snap-in" quick assembly and installation employing an interconnect embodiment of the invention as previously described. The "snap-in" technology minimizes the use of mechanical fasteners (e.g. screws) previously required for the installation of the electrical receptacle to an interconnect panel.

The airplane fabrication may be designed and fabricated in sections 602A-602F. For example, the nose 602A, fuselage 602B, 602D and 602E, wing/body center section 602C, wings and empennage 602F. Each of these airplane sections 602A-602F can be assembled by a structure supplier who will then install as much of the internal systems and equipments as possible. The final assembly factory will receive these pre-integrated sections 602A-602F and the electrical wiring will be connected at the junction locations 604A-604I which employ standard interconnects as previously detailed.

Figure 6:
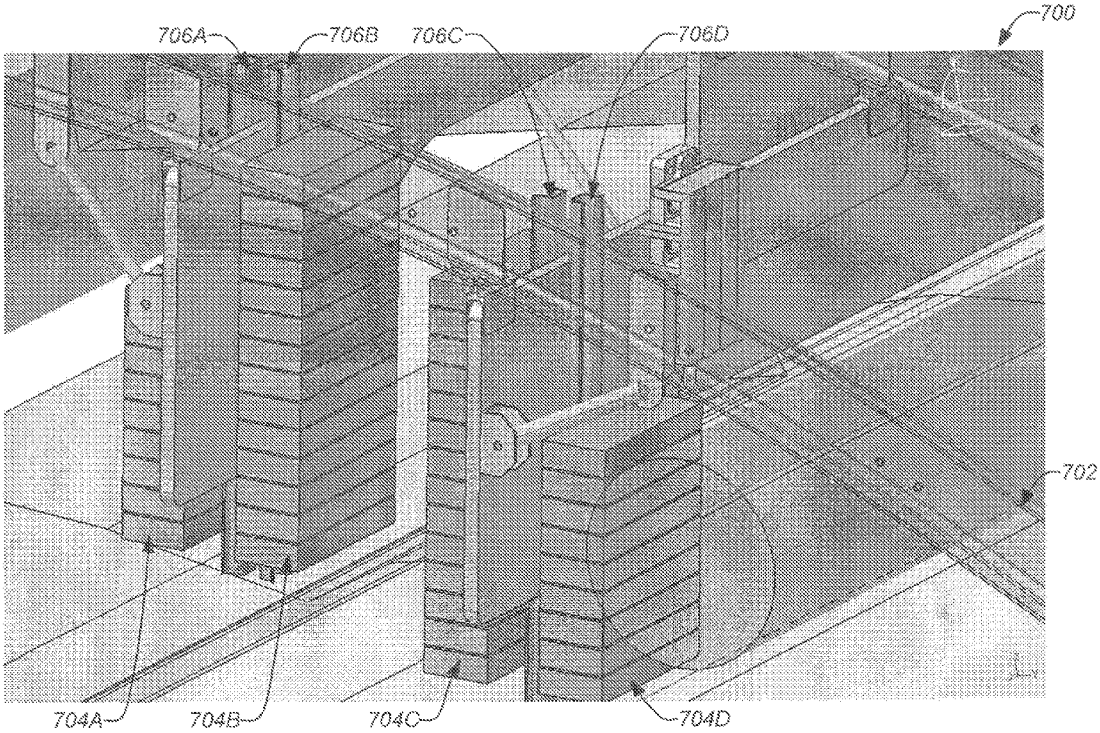
FIG. 6 illustrates employing an exemplary interconnect system embodiment of the present invention at an exemplary junction location between fuselage sections of a production aircraft.

FIG. 6 illustrates employing an exemplary interconnect system embodiment of the present invention at an exemplary junction location 700 between fuselage sections of a production aircraft. The junction location 700 shows a structural joint 702 between adjoining fuselage sections of an aircraft. Electrical wiring for the various aircraft systems are coupled between the fuselage sections through the use of electrical interconnects (each interconnect is depicted schematically as a rectangular prism in FIG. 6) as previously described. The modular electrical interconnects are organized in groups or banks 704A-704D comprising a plurality of interconnects at this location 700. Each of the interconnects of a particular group 704A-704D are coupled structurally and electrically to a common structural support 706A-706D as shown. In turn, the respective structural supports 706A-706D are coupled to the airframe and electrical grounding system of the aircraft.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. A system, comprising:

a structural support;

a plurality of electrical connector shells each supporting one or more couplable electrical conductors; and a modular bracket affixed to each of the plurality of electrical connector shells, each modular bracket manually clamped to the structural support;

wherein the structural support is part of an aircraft fuselage section and the plurality of electrical connector shells each support the one or more electrical conductors coupled between separate fuselage sections and wherein each of the plurality of electrical connector shells is adapted for coupling the one or more electrical conductors through a plug, where the plug engages the electrical connector shell with a manual slide-and-latch mechanism.

2. The system of claim 1, wherein each modular bracket comprises a catch and a spring latch mechanism for manually clamping to the structural support.

3. The system of claim 2, wherein the structural support comprises a rail and the catch is for engaging a first edge of the rail and the spring latch mechanism is for engaging an opposite edge of the rail.

4. The system of claim 1, wherein the manual slide-and-latch mechanism includes a visual indicator that the plug and the electrical connector shell are engaged.

5. The system of claim 1, wherein each of the plurality of electrical connector shells includes a polarization key for engaging the plug.

6. The system of claim 1, wherein the structural support comprises a rail.

7. The system of claim 1, wherein each modular bracket is capable of individually clamping the structural support.

8. The system of claim 1, wherein clamping of the modular bracket to the structural support provides an electrical connection between the modular bracket and the structural support.

9. The system of claim 1, wherein the plurality of electrical connector shells and each modular bracket comprise a metal plated polymer.

10. A system, comprising:

a structural support;

a plurality of electrical connector shells each supporting one or more couplable electrical conductors; and a modular bracket affixed to each of the plurality of electrical connector shells, each modular bracket manually clamped to the structural support;

wherein the structural support is part of an aircraft fuselage section and the plurality of electrical connector shells each support the one or more electrical conductors coupled between separate fuselage sections and wherein the structural support comprises a rail.

11. The system of claim 10, wherein each modular bracket comprises a catch and a spring latch mechanism for manually clamping to the structural support.

12. The system of claim 11, wherein the structural support comprises a rail and the catch is for engaging a first edge of the rail and the spring latch mechanism is for engaging an opposite edge of the rail.

13. A system, comprising:

a structural support;

a plurality of electrical connector shells each supporting one or more couplable electrical conductors; and a modular bracket affixed to each of the plurality of electrical connector shells, each modular bracket manually clamped to the structural support;

wherein the structural support is part of an aircraft fuselage section and the plurality of electrical connector shells each support the one or more electrical conductors coupled between separate fuselage sections and wherein each modular bracket is capable of individually clamping the structural support.

14. The system of claim 13, wherein each modular bracket comprises a catch and a spring latch mechanism for manually clamping to the structural support.

15. The system of claim 14, wherein the structural support comprises a rail and the catch is for engaging a first edge of the rail and the spring latch mechanism is for engaging an opposite edge of the rail.

* * * * *